US005393372A

United States Patent [19]

Ammon

[11] Patent Number: 5,393,372

[45] Date of Patent: Feb. 28, 1995

[54] METHOD OF DISPLAYING INDICIA ON FOOTWEAR

[75] Inventor: Stephen D. Ammon, Newburyport, Mass.

[73] Assignee: Fila U.S.A., Inc., Hunt Valley, Md.

[21] Appl. No.: 154,968

[22] Filed: Nov. 19, 1993

[51] Int. Cl.[6] ..... B44C 1/22

[52] U.S. Cl. ..... 156/629; 156/633; 156/655; 156/668; 156/242; 156/277; 156/63

[58] Field of Search ..... 156/629, 633, 654, 655, 156/659.1, 668, 242, 245, 277, 63, 93; 36/87, 98, 136, 14, 30, 31, 45, 50.1; 264/509, 132, 244, 245, 250; 283/117

[56] References Cited

U.S. PATENT DOCUMENTS

| | | | |
|---|---|---|---|
| 2,706,833 | 4/1955 | Doherty | 156/63 |
| 3,664,913 | 5/1972 | Ratcliff | 156/345 |
| 5,165,190 | 11/1992 | Smyth | 36/50 |

*Primary Examiner*—William Powell
*Attorney, Agent, or Firm*—Davis Hoxie Faithfull & Hapgood

[57] ABSTRACT

A method displaying a self-authenticating indicia on footwear is described. In one embodiment, a first segment of the indicia is displayed on the upper of the shoe, and a second segment is displayed on the sidewall. Alternately, the indicia may be in three segments which are displayed on the upper, sidewall and bottom of the sole. In each embodiment the segments are aligned to form the full indicia when the shoe is manufactured.

20 Claims, 3 Drawing Sheets

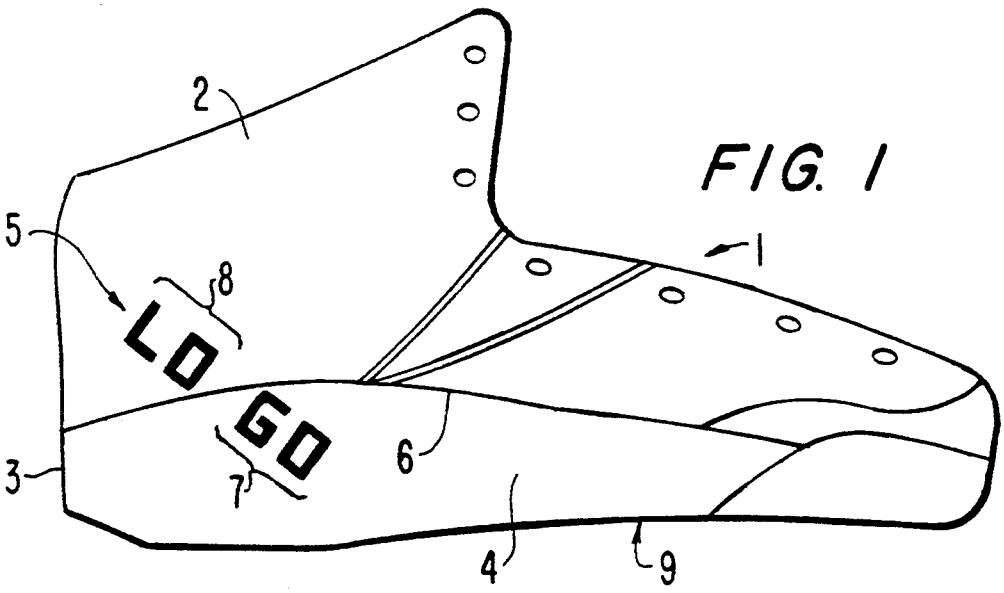
FIG. 1
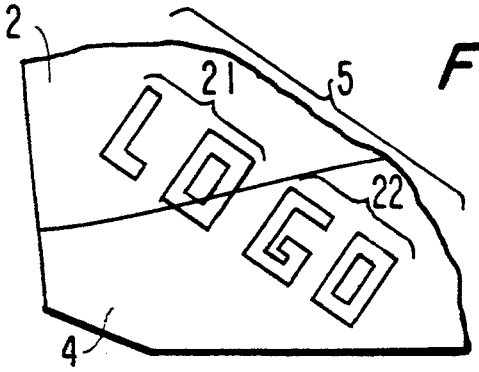
FIG. 2
FIG. 2A
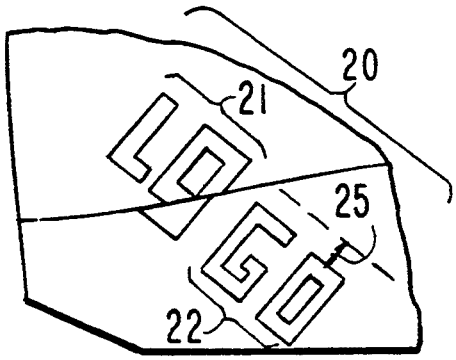
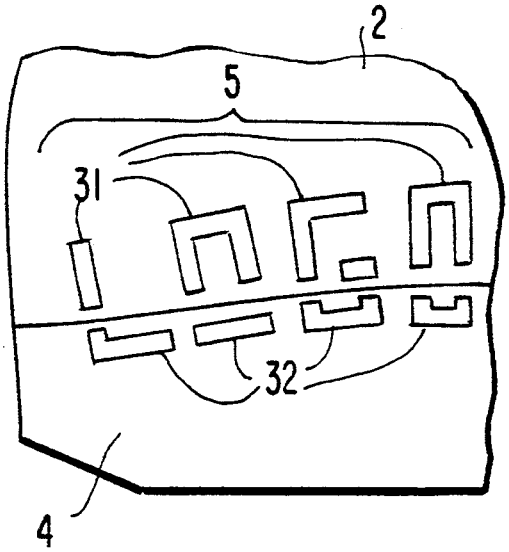
FIG. 3

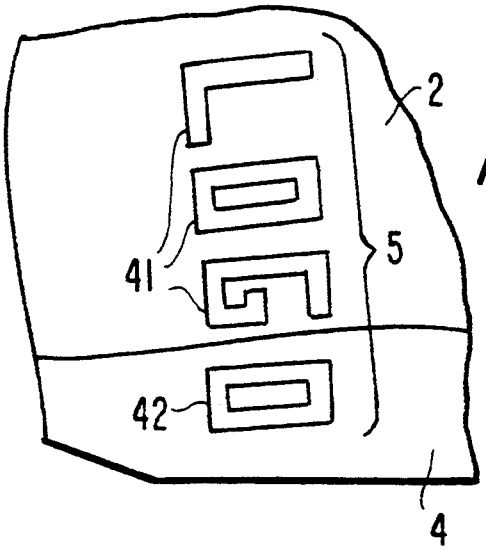
FIG. 4
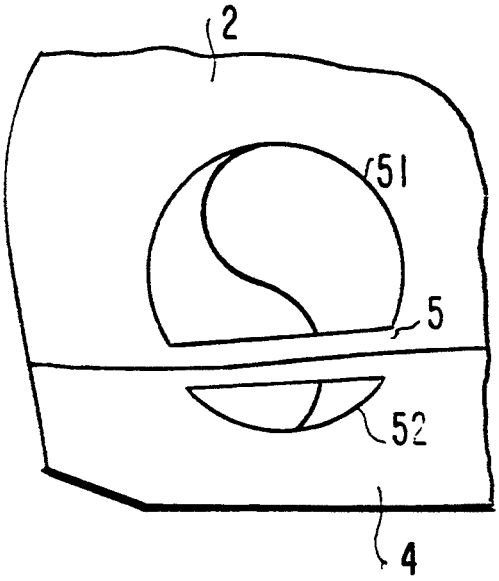
FIG. 5
FIG. 6
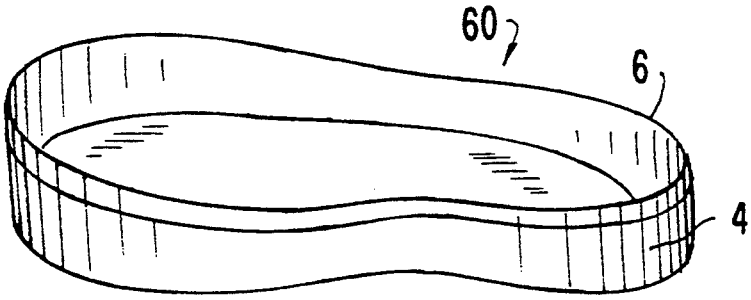

METHOD OF DISPLAYING INDICIA ON FOOTWEAR

BACKGROUND OF THE INVENTION

Indicia, such as a model name, a manufacturer's name, a logo, a trademark or other symbol, are commonly displayed on footwear. The indicia are typically located on the sides, front or back of the footwear, and preferably can be read while the footwear is in use.

Typically, the indicia are displayed on the upper, using, for example, heat-seal embossed, embroidered, screen printed or appliquè lettering. Alternatively, the indicia are displayed on the exposed sidewalls or the bottom of the sole, using letters integrally molded in, etched or painted on the sole material.

In implementing these methods of displaying indicia on footwear, manufacturers have encountered several problems. First, while a large size is desirable in order to maximize the readability of the indicia, the area available on the upper portion, or on the sidewall, limits the size of the indicia that can be used. Second, if the indicia are displayed high on the upper, they could be obscured by a trouser cuff. Third, although locating the indicia on a lower portion of the footwear can improve readability, the exposed sidewalls of the sole are prone to collecting dirt which can completely obscure the indicia. Furthermore, locating the indicia completely on the sidewall severely limits the size of the indicia that can be used.

Yet further, the problem of counterfeiting high-quality footwear has been increasing. Unlicensed manufacturers counterfeit the appearance and style of a particular article of footwear, including, in some cases, a manufacturer's identification, such as a logo. Such counterfeiting usually cannot be easily detected by the consumer. A need therefore exists for a method of displaying a manufacturer's identification on a shoe that is not easily reproduced. Such a method would permit a consumer to quickly and easily identify a lower quality imitation.

SUMMARY OF THE INVENTION

An object of the invention is to provide a method of displaying indicia on footwear whereby the size of the indicia is not limited by the space available on the upper portion of the footwear or on the sidewall, but instead takes advantage of the combined surface area of these elements.

A further object of the invention is to locate the indicia in the lowest possible position on the footwear so that the indicia are not obscured by trouser cuffs, while avoiding the problems of locating the indicia completely on the sidewall.

Yet a further object of the invention is to provide a method of displaying a self-authenticating manufacturer's identification on an article of footwear in such a way that a counterfeit article is easily recognized.

The invention provides a method for displaying indicia on footwear whereby a single indicia is displayed partially on the upper portion of the footwear, and partially on the sole. Part of the indicia is heat-seal embossed, embroidered, printed, appliquèd, or otherwise applied to the upper, and the remainder of the indicia is integrally molded, painted, or otherwise applied on the sole. The two parts are aligned to form the full indicia when the upper is joined to the sole during manufacture of the shoe.

The invention furthermore gives the footwear an integrated appearance because the indicia provide a unifying feature between the sole and the upper, which interrupts the boundary or interface line between the sole and the upper.

BRIEF DESCRIPTION OF THE DRAWINGS

FIG. 1 is a side view of a shoe having indicia according to the present invention;

FIG. 2 is an enlarged detail view of the indicia of FIG. 1, showing the indicia oriented at an angle to the horizontal;

FIG. 2A is an enlarged detail view of a misaligned indicia;

FIG. 3 is an enlarged detail view of indicia oriented horizontally according to another embodiment of the invention;

FIG. 4 is an enlarged detail view of vertically oriented indicia according to another embodiment of the invention;

FIG. 5 is an enlarged detail view of indicia according to yet another embodiment of the invention;

FIG. 6 is a perspective view of the construction of a one-piece sole;

Figure 7:
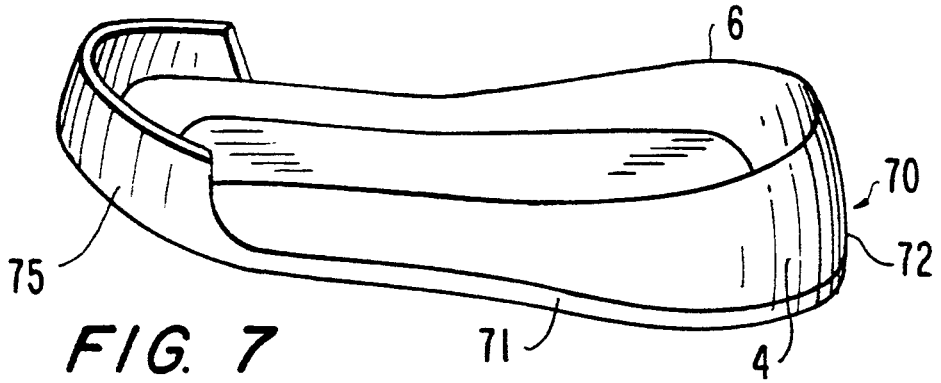
FIG. 7 is a perspective view of the construction of a two-piece sole.

It should be noted that none of the figures are drawn to scale, and that, for clarity, like components in the figures are numbered the same.

DETAILED DESCRIPTION

FIG. 1 illustrates an article of footwear 1 having an upper portion (or "upper") 2, and a sole 3 having a sidewall 4 and a bottom 9. An interface line 6 is formed when the upper portion 2 and the sidewall 4 of the sole are joined. Interface line 6 thus forms a substantially continuous boundary between the sole and the upper.

Referring to FIG. 6, a one-piece "shell sole" or "cup sole" 60 is molded from a relatively hard elastomer such as rubber. The shell sole is attached directly to the upper 2 using a process such as stitching, bonding or gluing. The shell sole 60 has a sidewall 4, which is visible when the user is in a normal standing position. The upper (not shown) is attached at interface line 6.

Referring to FIG. 7, a typical two-piece sole 70 construction is illustrated. The two-piece sole 70 has an outsole 71, molded from a relatively hard elastomer such as rubber, and a midsole 72 molded from a somewhat softer material such as ethyl vinyl acetate (EVA) or polyurethane. The midsole 72 and the outsole 71 are attached to form the two-piece sole 70, which is then attached to the upper at interface line 6. The outsole 71 comprises that area of the sole 73 that contacts the ground. As shown in FIG. 7, the outsole 71 may extend up around the midsole 72 in the toe area 75, to directly contact the upper (not shown). In this case, interface line 6 between the upper and the sole is defined by the outsole 71 in the toe area 75. Therefore, the sidewall 4 of a sole is defined herein as those portions of the outsole and midsole that are visible when the user is in a normal standing position.

Referring to FIG. 1, the indicia 5 comprises the letters forming the word "LOGO", which are displayed on the article of footwear 1. A first segment 8 of the indicia 5 is displayed on the upper portion 2 of the footwear. This segment of the indicia is displayed, for example, by embroidering a pattern, by sewing an appliquè pattern, by heat-seal embossing, or by screen printing on the upper.

A second segment 7 of the indicia 5 is displayed on the sidewall 4. This segment of the indicia is displayed, for example, by molding a pattern into sidewall 4, or by painting or printing. As illustrated in FIG. 1, the interface line 6 passes through the indicia 5. Thus, the indicia serves to unify or integrate the sidewall 4 and the upper 2. It should be understood that while the indicia of FIG. 1 are shown in the heel area, they can be displayed at any location along the perimeter of interface line 6.

As shown in FIG. 1, the upper 2 must be properly aligned with the sole 3 in order for the indicia 5 to be correctly displayed. The indicia are therefore self-authenticating because a consumer can easily detect misalignment, and thus inferior assembly quality used by counterfeiters, merely by looking at the indicia.

FIG. 2 is an enlarged partial side view of the embodiment of FIG. 1 wherein the indicia are displayed at an acute angle to the horizontal. A first segment 21 of the indicia 5 is displayed on the upper portion 2 of the footwear, and consists of the first portion of a manufacturer's trademark, symbol or logo. A second segment 22 of the indicia 5 is displayed on the sidewall 4, and consists of the remaining portion of the logo. While the example in FIG. 2 shows indicia oriented generally at 45 degrees from the horizontal, it is understood that the indicia of this embodiment can be oriented at any angle.

FIG. 2A depicts an article of footwear having a misaligned logo 20 to illustrate the self-authenticating characteristic of the invention. A counterfeiter attempting to copy the footwear typically uses inferior quality materials and methods when constructing shoes. Such inferior methods will not enable a counterfeiter to align the segments 21 and 22 of the indicia 20, and the misalignment represented by arrow 25 can be easily detected by a consumer, thereby providing identification of counterfeit footwear.

FIG. 3 is an enlarged partial side view of an embodiment of the invention whereby the indicia 5 are displayed in a generally horizontal orientation. Each of the indicia 5 is displayed so that an upper segment 31 of the indicia is on upper portion 2 of the article of footwear, and a lower segment 32 of the indicia is on the sidewall 4. In this example, each of the indicia represents a stylized letter of a manufacturer's logo.

FIG. 4 is an enlarged partial side view of an embodiment of the invention whereby the indicia 5 are displayed in a generally vertical orientation. A first segment 41 of the indicia 5 is displayed on the upper portion 2 of the footwear, and consists of the first several stylized letters of a manufacturer's logo. A second segment 42 of the indicia is displayed on the sidewall 4, and consists of the remaining letters of the logo.

FIG. 5 is an enlarged partial side view of an embodiment of the invention whereby the indicia 5 comprise a non-alphanumeric symbol that may or may not require rotational orientation. A first segment 51 of the indicia 5 is displayed on the upper 2, and consists of the upper portion of a graphic symbol. A second segment 52 of the indicia is displayed on the sidewall 4, and consists of the remaining part of the symbol. Misalignment of the upper 2 and the sole 4 can easily be detected by a consumer by observing the symbol.

Figure 8:
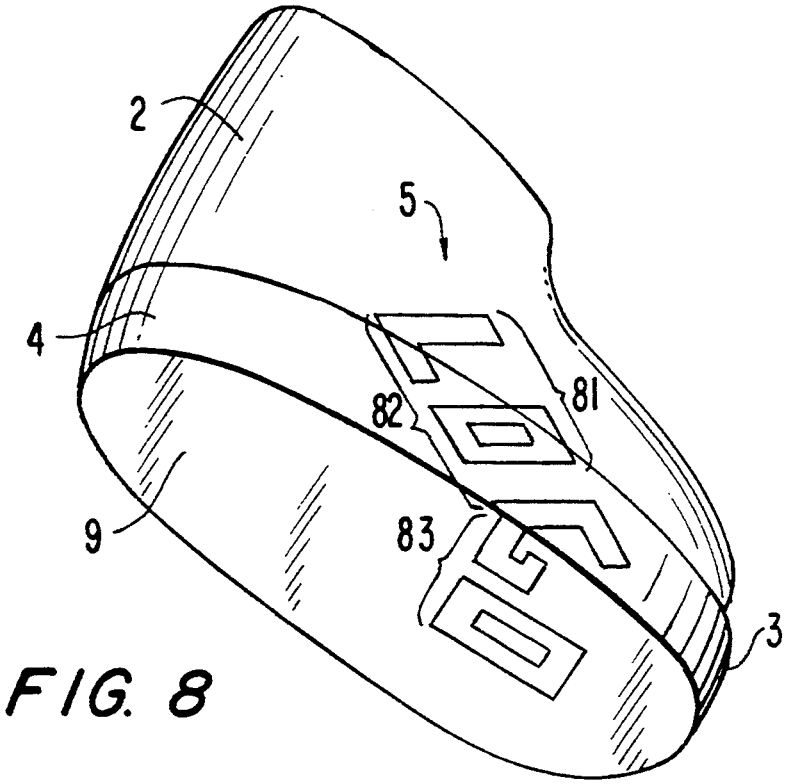
FIG. 8 is a perspective view of a shoe with indicia according to another embodiment of the invention.

FIG. 8 is a perspective bottom and side view of an article of footwear showing an embodiment of the invention whereby the indicia 5 are displayed in an area encompassing the bottom 9 of the sole as well as the sidewall 4 and upper 2. A first segment 81 of the indicia 5 is displayed on the upper portion 2 of the footwear. A second segment 82 of the indicia 5 is displayed on the sidewall 4, and a third segment 83 is displayed on the bottom 9 of the sole 3. In this example, the indicia comprises stylized letters of a manufacturer's logo. The portions 81, 82 and 83 include parts of the stylized letters as necessary to conform to the geometry of the footwear.

In FIGS. 1–4 and 8, the indicia are pictured to be generally read from left to right or from top to bottom. However, it is understood that such illustrations are not meant to limit the invention. For example, the indicia may be applied in the reverse or mirror-image orientation.

In addition, for purposes of clarity the indicia described above with respect to FIGS. 1–5 are shown located near the heel area. It should be understood that the present invention is not limited to displaying indicia in this location, but also comprises indicia in other locations of the shoe. For example, locations near the toe, heel, and areas along the left or right sides of the footwear, such as that shown in FIG. 8, can be used. Furthermore, in the case of a one-piece sole, the indicia can be partly displayed on the shell sole and partly displayed on the upper. In the case of a two-piece sole, the indicia can be displayed partly on the upper and partly on the midsole, or partly on the upper and partly on the outsole, or partly on each of the upper, midsole and outsole.

Further, the indicia shown in the FIGS. 1–5 and 8 comprise a block-lettered logo or geometric symbol. However, other stylized lettering, non-geometric symbols and other logos can be used, as long as two or more distinct parts of the indicia are located and aligned on the upper and sidewall, or upper, sidewall and bottom of the sole. In addition, the percentage of the indicia appearing on either the upper or the sole can vary according to design choice. Yet further, more than one indicia according to the invention can be used on an article of footwear.

It is understood that the above-described embodiments are merely illustrative and that many variations can be devised by those of skill in the art without departing from the scope of the invention.

I claim:

1. A method for displaying indicia on footwear having a sole and an upper portion, wherein the sole has a sidewall, the method comprising:
   - applying a first segment of the indicia to the upper portion;
   - applying a second segment of the indicia to the sidewall of the sole; and
   - aligning the first and second segments to form the indicia during assembly of the upper portion to the sole.

2. The method of claim 1, wherein the indicia are oriented at an angle to the horizontal.

3. The method of claim 1, wherein the indicia are oriented horizontally.

4. The method of claim 1, wherein the indicia are oriented vertically.

5. The method of claim 1, wherein the first segment of the indicia is embroidered on the upper portion.

6. The method of claim 1, wherein the first segment of the indicia is screen printed on the upper portion.

7. The method of claim 1, wherein the first segment of the indicia is appliquèd on the upper portion.

8. The method of claim 1, wherein the second segment of the indicia is molded on the sole.

9. The method of claim 1, wherein the second segment of the indicia is painted on the sole.

10. The method of claim 1, wherein the second segment of the indicia is etched on the sole.

11. A method for displaying indicia on footwear having a sole and an upper portion, wherein the sole has a sidewall and a bottom, the method comprising:

applying a first segment of the indicia to the upper portion;

applying a second segment of the indicia to the sidewall of the sole;

applying a third segment of the indicia to the bottom of the sole; and aligning the first, second and third segments to form the indicia during assembly of the footwear.

12. The method of claim 11, wherein the indicia are oriented at an angle to the horizontal.

13. The method of claim 11, wherein the indicia are oriented horizontally.

14. The method of claim 11, wherein the indicia are oriented vertically.

15. The method of claim 11, wherein the first segment of the indicia is embroidered on the upper portion.

16. The method of claim 11, wherein the first segment of the indicia is screen printed on the upper portion.

17. The method of claim 11, wherein the first segment of the indicia is appliquèd on the upper portion.

18. The method of claim 11, wherein the second and third segments of the indicia are molded on the sole.

19. The method of claim 11, wherein the second and third segments of the indicia are painted on the sole.

20. The method of claim 11, wherein the second and third segments of the indicia are etched on the sole.

* * * * *

US005393372B1

REEXAMINATION CERTIFICATE (3572nd)

United States Patent [19] [11] B1 5,393,372

Ammon [45] Certificate Issued Jul. 14, 1998

[54] METHOD OF DISPLAYING INDICIA ON FOOTWEAR

[75] Inventor: Stephen D. Ammon, Newburyport, Mass.

[73] Assignee: Fila U.S.A., Inc., Hunt Valley, Md.

Reexamination Requests:
No. 90/004,034, Nov. 21, 1995
No. 90/004,408, Oct. 7, 1996

Reexamination Certificate for:

| | |
|---|---|
| Patent No.: | **5,393,372** |
| Issued: | **Feb. 28, 1995** |
| Appl. No.: | **154,968** |
| Filed: | **Nov. 19, 1993** |

[51] Int. Cl.[6] ..... B44C 1/22
[52] U.S. Cl. ..... 216/33; 156/63; 156/242; 156/277; 216/58; 216/83
[58] Field of Search ..... 216/33

[56] References Cited

U.S. PATENT DOCUMENTS

| | | |
|---|---|---|
| D. 100,581 | 6/1936 | Runstein . |
| D. 240,973 | 8/1976 | Tesky . |
| D. 315,442 | 3/1991 | Kilgore et al. . |
| D. 326,763 | 6/1992 | Holbrook . |
| D. 353,705 | 12/1994 | Hatfield . |
| D. 353,706 | 12/1994 | Telles . |
| 2,016,903 | 10/1935 | Miller . |

OTHER PUBLICATIONS

FILA Footwear Catalog, Fall 1994, p. 16.
Clarks, *Manual of Shoemaking*, C & J Clarks Ltd., Second Edition 1976, pp. 203–208.
Ferragamo, Salvatore, *Leaders of Fashion*, Italy: Officine Grafiche Fratelli Stianti spa, c1985, p. 133.
Provoyeur, Pierre, *Vivier*, Paris: Editions du Regard, c1991, p. 198.
Trasko, Mary, *Heavenly Soles: Extraordinary Twentieth--Century Shoes*, New York: Abbeville Press, c1989, p. 118.
Andritzky, Michael, et al., *Z.B. Schuhe: vom blossen Fuss zum Stoeckelschuh*, Anabas Verlag, 1988, p. 143.
Katz, Ruth J., FOOTWEAR: *Shoes & Socks You Can Make Yourself*, New York: Van Nostrand Reinhold Co., 1979, p. 104.
"Sportstyle," Feb. 3, 1992, vol. 14, Issue 3, p. 55 and insert between pp. 56 and 57.
"FN: Footwear News," Feb. 1, 1993, vol. 49, No. 5, insert between pp. 16 and 17.
D.J. Yang, Step by Step with Nike, "Business Week," Aug. 13, 1995, pp. 116 and 177.
Color Copies of Color Photographs of the Nike Air 180, date unknown.
The Nike Publication for the Nike Air 180, date unknown.
"FN: Footwear News," Dec. 21, 1992, vol. 48, No. 51, p. 19.
Reebok Footwear Fall 1993, copyright 1992, p. 40 and part of p. 41.
Reebok Footwear Spring 1994, copyright 1993, cover page.

*Primary Examiner*—William A. Powell

[57] ABSTRACT

A method displaying a self-authenticating indicia on footwear is described. In one embodiment, a first segment of the indicia is displayed on the upper of the shoe, and a second segment is displayed on the sidewall. Alternately, the indicia may be three segments which are displayed on the upper, sidewall and bottom of the sole. In each embodiment the segments are aligned to form the full indicia when the shoe is manufactured.

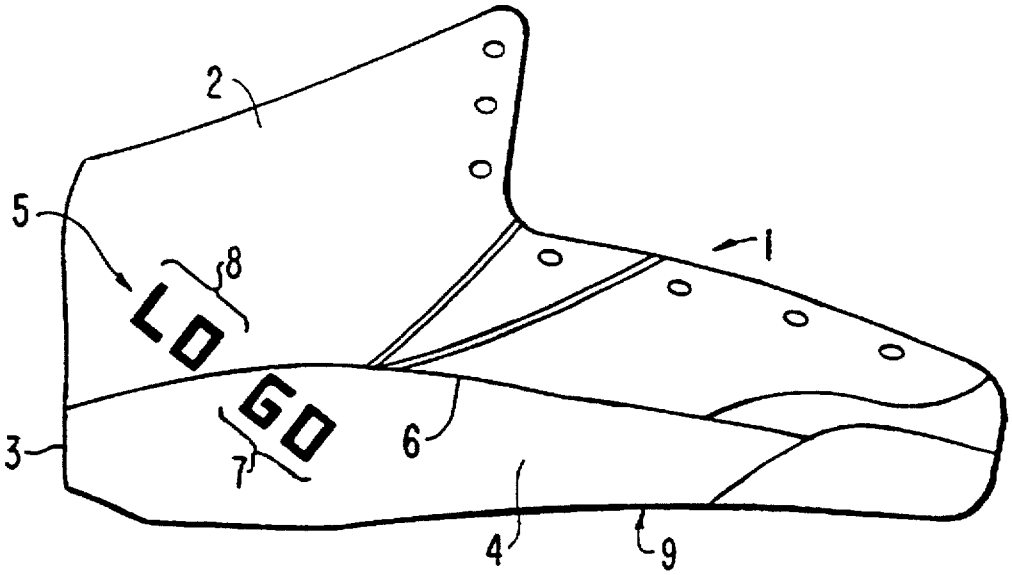

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–20 are cancelled.

* * * * *